US008122874B2

(12) United States Patent
LoRocco et al.

(10) Patent No.: US 8,122,874 B2
(45) Date of Patent: Feb. 28, 2012

(54) DETACHABLE QUIVER MOUNT ASSEMBLY FOR ARCHERY BOWS

(75) Inventors: Paul LoRocco, Dallas, TX (US); Mark Garcia, Belgrade, MT (US)

(73) Assignee: Truglo, Inc., Richardson, TX (US)

( * ) Notice: Subject to any disclaimer, the term of this patent is extended or adjusted under 35 U.S.C. 154(b) by 304 days.

(21) Appl. No.: 12/534,594

(22) Filed: Aug. 3, 2009

(65) Prior Publication Data

US 2010/0024793 A1 Feb. 4, 2010

Related U.S. Application Data

(60) Provisional application No. 61/086,089, filed on Aug. 4, 2008.

(51) Int. Cl.
*F41B 5/06* (2006.01)

(52) U.S. Cl. ..... 124/88; 124/25.5; 124/25.7; 124/44.5; 124/44.6; 124/86; 224/916

(58) Field of Classification Search ..... 124/44.5, 124/44.6, 86, 88, 25.5, 25.7; 224/916
See application file for complete search history.

(56) References Cited

U.S. PATENT DOCUMENTS 3,366,101 A * 1/1968 Saunders ..... 124/88
3,777,734 A * 12/1973 Rose ..... 124/25.5
3,801,767 A * 4/1974 Marks ..... 200/543
4,020,984 A * 5/1977 Morris ..... 124/88
4,156,496 A * 5/1979 Stinson ..... 124/25.7
4,195,616 A * 4/1980 Darlington ..... 124/25.7
4,252,101 A * 2/1981 Spitzke ..... 124/45
4,607,606 A * 8/1986 Schaar ..... 124/89
4,621,606 A * 11/1986 Toth ..... 124/24.1
4,635,611 A * 1/1987 Priebe ..... 124/25.7
4,685,438 A * 8/1987 Larson ..... 124/25.7
4,704,800 A * 11/1987 Stinson ..... 33/265
4,788,961 A * 12/1988 Toth ..... 124/25.5
4,995,372 A * 2/1991 Topel ..... 124/25.5
5,005,554 A * 4/1991 Shepley et al. ..... 124/24.1
5,076,522 A * 12/1991 Stinson ..... 248/216.1
5,265,584 A * 11/1993 Judson et al. ..... 124/86
5,265,585 A * 11/1993 Stinson ..... 124/88
5,566,665 A * 10/1996 Stinson ..... 124/86
5,593,121 A * 1/1997 Tackett ..... 248/218.4
5,775,314 A * 7/1998 Michael et al. ..... 124/86
5,934,531 A * 8/1999 Jablonic et al. ..... 224/222
6,006,734 A * 12/1999 Sodaro ..... 124/86
6,105,566 A * 8/2000 Tiedemann ..... 124/86
6,672,299 B2 * 1/2004 Proctor ..... 124/86
6,725,853 B2 * 4/2004 Foddrill ..... 124/86
7,942,141 B1 * 5/2011 Love et al. ..... 124/86
7,987,842 B2 * 8/2011 McPherson ..... 124/86
2002/0062826 A1 * 5/2002 Proctor ..... 124/86

* cited by examiner

*Primary Examiner* — Gene Kim
*Assistant Examiner* — Alexander Niconovich
(74) *Attorney, Agent, or Firm* — Alvin R. Wirthlin

(57) ABSTRACT

A detachable quiver mount assembly comprises a bow mounting portion connectable to an archery bow and a quiver mounting portion releasably connectable to the bow mounting portion. At least one of the mounting portions includes at least one magnet for attracting and holding the other of the mounting portions.

20 Claims, 5 Drawing Sheets

DETACHABLE QUIVER MOUNT ASSEMBLY FOR ARCHERY BOWS

RELATED APPLICATIONS

This application claims the benefit of U.S. Provisional Application No. 61/086,089 filed on Aug. 4, 2008.

BACKGROUND OF THE INVENTION

This invention relates to quivers for archery bows, and more particularly to a quiver mount assembly that is removably connectable to an archery bow.

During hunting or target shooting with an archery bow, it is convenient to have a quantity of arrows readily available to the archer for fast reload. Thus, open rack quivers have been used which are attached to the bow on the side opposite the sight window. During hunting, target practice, transportation and/or storage of the archery bow and its accessories, it is sometimes desirable to quickly remove and attach the quiver for various reasons. Many of these quivers are attached in such a way that it is necessary to unscrew or unbolt the mount to remove the quiver. This can be a difficult and time consuming process, especially when hand tools are required.

SUMMARY OF THE INVENTION

In accordance with one aspect of the invention, a detachable quiver mount assembly includes a bow mounting portion connectable to an archery bow and a quiver mounting portion releasably connectable to the bow mounting portion. At least one of the mounting portions includes at least one magnet for attracting and holding the other of the mounting portions.

In accordance with a further aspect of the invention, a detachable quiver mount assembly includes a bow mounting portion connectable to an archery bow and a quiver mounting portion releasably connectable to the bow mounting portion. The bow mounting portion has one of a receptacle and a protruding member while the quiver mounting portion has the other of the receptacle and protruding member. The protruding member is insertable into the receptacle to thereby connect the mounting portions together. A releasable holding means is associated with at least one of the protruding member and the receptacle to detachably hold the mounting portions together.

In accordance with yet another aspect of the invention, a detachable quiver mount assembly includes a bow mounting portion connectable to an archery bow and a quiver mounting portion releasably connectable to the bow mounting portion. The bow mounting portion has a first body section with a receptacle and the quiver mounting portion has a second body section with a protruding member. The protruding member is insertable into the receptacle to thereby connect the mounting portions together. A first magnet portion is located within the receptacle and includes a first plurality of stacked magnets and a plug constructed of magnetically permeable material. A second magnet portion is connected to the protruding member and includes a second plurality of stacked magnets and a holder constructed of magnetically permeable material. The first and second magnet portions are mutually attracted when the protruding member is positioned in the receptacle for releasably securing the bow mounting portion and quiver mounting portion together.

It is noted that the drawings are intended to depict only typical embodiments of the invention and therefore should not be considered as limiting the scope thereof. It is further noted that the drawings may not be to scale. The invention will now be described in greater detail with reference to the accompanying drawings.

DETAILED DESCRIPTION OF THE INVENTION

Figure 1:
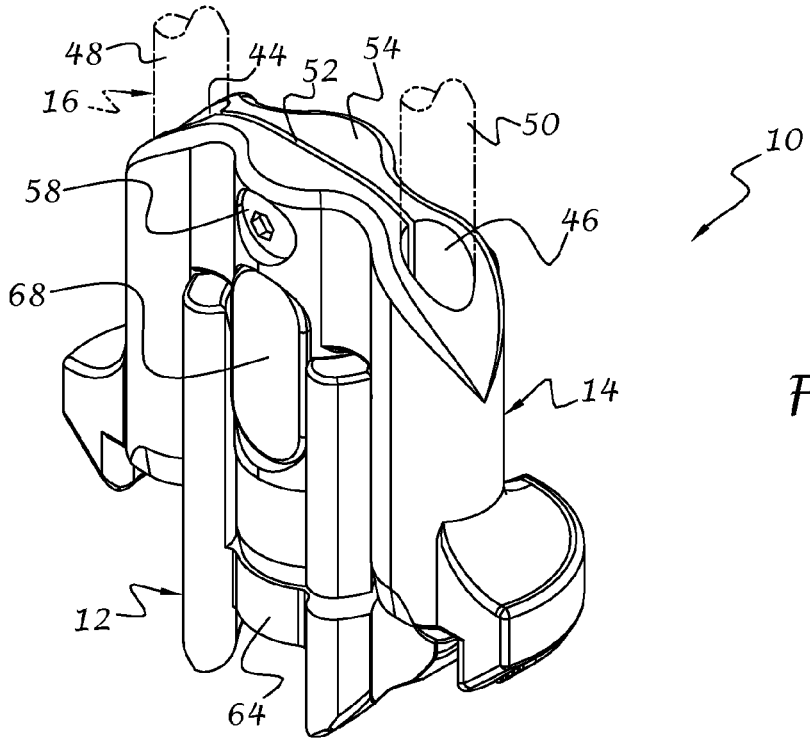
FIG. 1 is a front isometric view of a detachable quiver mount assembly for archery bows in accordance with the present invention.
Figure 2:
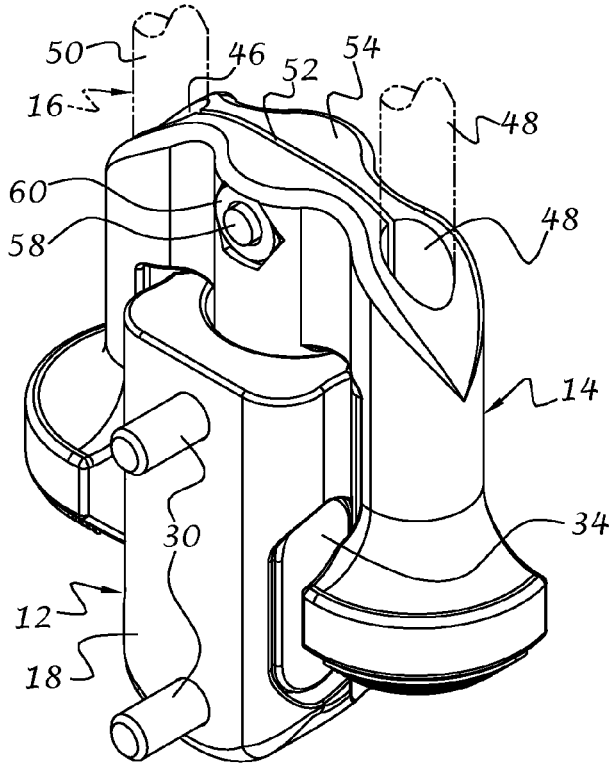
FIG. 2 is a rear isometric view of the quiver mount assembly.
Figure 3:
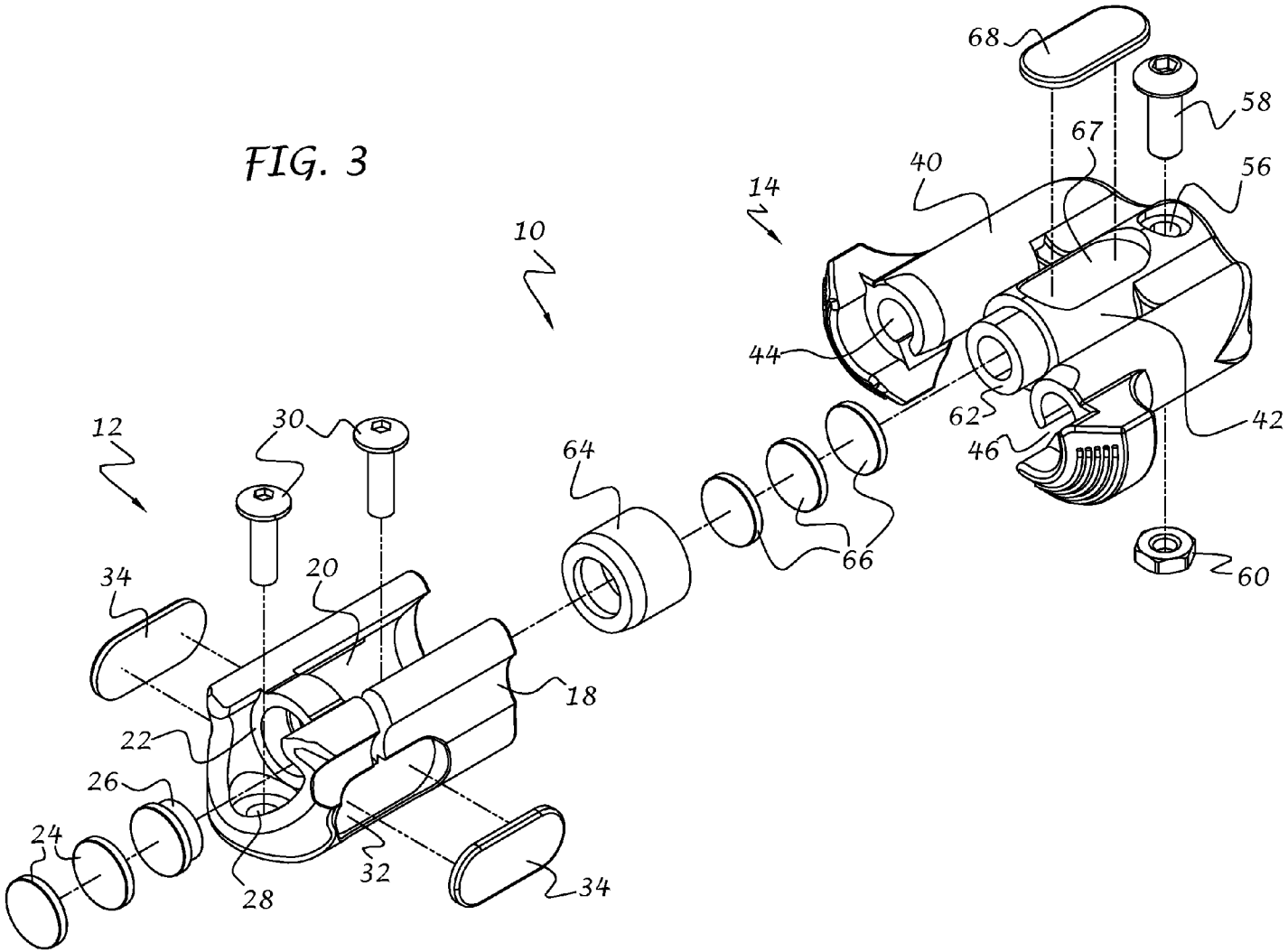
FIG. 3 is an exploded bottom isometric view of the quiver mount assembly.
Figure 4:
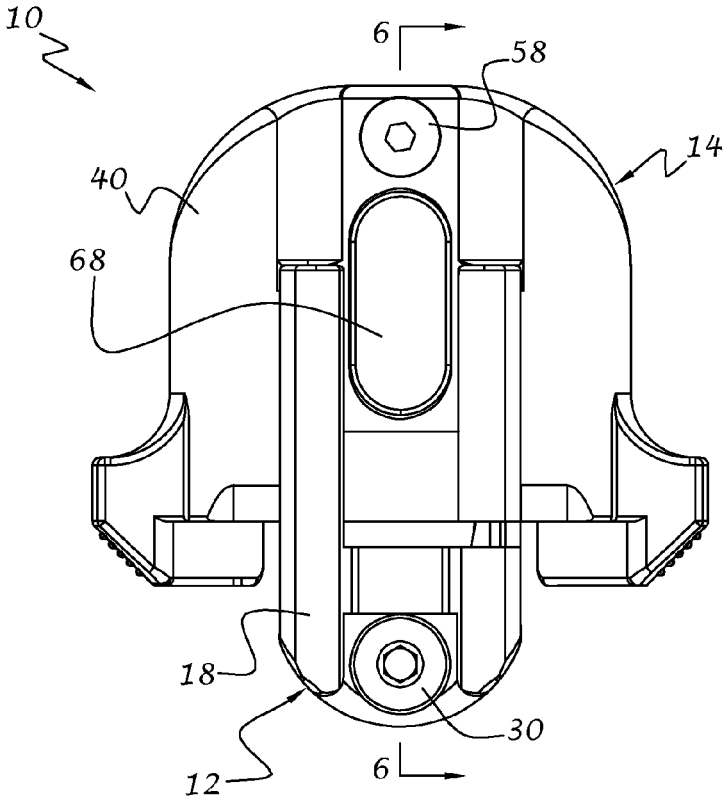
FIG. 4 is a front elevational view of the quiver mount assembly.
Figure 5:
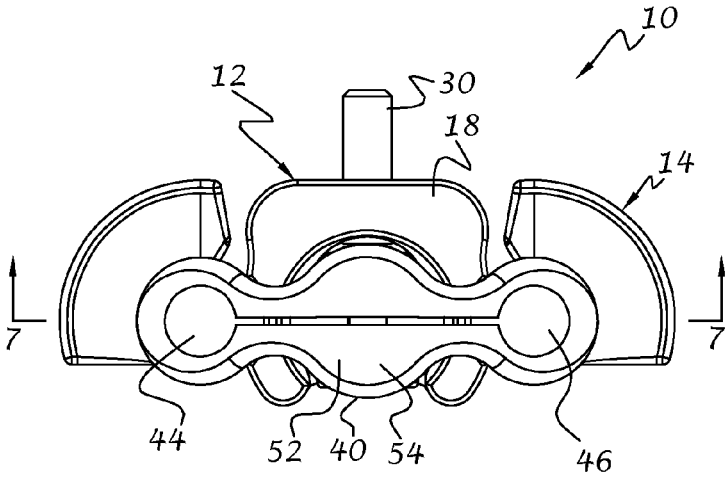
FIG. 5 is a top plan view of the quiver mount assembly.

Referring now to the drawings, and to FIGS. 1 and 2 in particular, a detachable quiver mount assembly 10 in accordance with the present invention is shown. The quiver mount assembly 10 of the present invention can be adapted for use with any type of bow (not shown) including, but not limited to, recurve bows, reflex bows, longbows, compound bows, crossbows, and so on.

The quiver mount assembly 10 preferably includes a bow mounting portion 12 that attaches to a bow (not shown) in a conventional manner and a quiver mounting portion 14 that attaches to a quiver 16, a portion of which is shown in phantom line in FIGS. 1 and 2. The quiver mounting portion 14 is releasably connected to the bow mounting portion 12, preferably through a magnetic arrangement as will be described in greater detail below. However, it will be understood that other releasable connection means can be associated with the bow and/or quiver mounting portions, including but not limited to hook and loop fasteners, temporary adhesives, friction, mutually engageable locking members such as clips, and so on.

With additional reference to FIGS. 3-10, the bow mounting portion 12 preferably includes a first body section 18 with a receptacle or internal cavity 20, preferably of generally cylindrical shape, and a ring 22 located within the cavity 20. A first magnet portion preferably includes a plug 26 and a pair of disk-shaped magnets 24 that are received within the ring 22. Although two magnets 24 are shown for the bow mounting portion 12, it will be understood that more or less magnets can be used. The magnets 24 can be constructed of any well-known magnetic material. Preferably, the plug 26 is constructed of magnetically permeable material such as nickel-plated steel with a high iron content. However, it will be understood that other materials can be used. A pair of countersunk openings 28 are formed in the first body section 18 for receiving fasteners 30, preferably in the form of hex-head screws. The fasteners 30 are adapted to engage well-known threaded mounting apertures associated with a bowsight mounting bracket (not shown) which is in turn mounted to the riser of an archery bow (not shown) to securely connect the bow mounting portion 12 thereto. Elongate depressions 32 can be formed in opposite sides of the body section 18 and a label 34 can be located in each depression through adhesives or other connecting means. One or both labels 34 can include information relating to the manufacturer, instructions on how to use the assembly 10, and so on.

The quiver mounting portion 14 preferably includes a second body section 40 with a centrally positioned protruding tubular member 42 and side bores 44, 46 positioned at opposite sides of the tubular member 42. The side bores 44 and 46 are adapted to receive parallel rods 48 and 50, respectively (shown in phantom line in FIGS. 1 and 2) of the quiver 16. A slot 52 is formed in an upper wall 54 of the second body section 40 and extends between the side bores 44, 46. A countersunk opening 56 extends through the second body section 40 and intersects the slot 52. A threaded fastener 58, preferably in the form of a hex-head screw, is inserted through the opening 56 and a nut 60 is threaded onto the screw 58. With this arrangement, the rods 48, 50 can be inserted into their respective side bores 44, 46 and the screw 58 can be rotated to narrow the width of the slot 52 and thus clamp the rods within their respective side bores for securing the quiver 16 to the quiver mounting portion 14. When it is desired to adjust the position of the quiver 16 with respect to the quiver mounting portion 14, the screw 58 can be loosened and the rods 48, 50 can be slid through the bores 44, 46, respectively, until the desired position is achieved. The screw 58 is then tightened to secure the quiver 16 to the mounting portion 14 at the adjusted position.

A reduced diameter portion 62 is formed on the tubular member 42 for receiving a second magnet portion which includes a cup-shaped holder or cover 64 and magnets 66 which are preferably inserted into the holder 64 before its installation onto the portion 62 in order to retain the magnets within the holder. Preferably, the holder 64 is received on the portion 62 in a press-fit engagement, although other connection means are contemplated. Although three magnets 66 are shown for the quiver mounting portion 14, it will be understood that more or less magnets can be used. The magnets 66 can be constructed of any well-known magnetic material. The holder 64 is preferably constructed of magnetically permeable material, such as steel with a high iron content. However, it will be understood that other materials can be used. Preferably, the magnets 24 of the bow mounting portion 12 and the magnets 66 of the quiver mounting portion 14 are arranged in the same North-South polarity so that the quiver and bow mounting portions are magnetically attractive to normally hold the portions together.

An elongate depression 67 can be formed in the tubular member 42 and a label 68 can be located in the depression 67 through adhesives or other connecting means. The label 68 can include information relating to the manufacturer, instructions on how to use the assembly 10, and so on.

Figure 6:
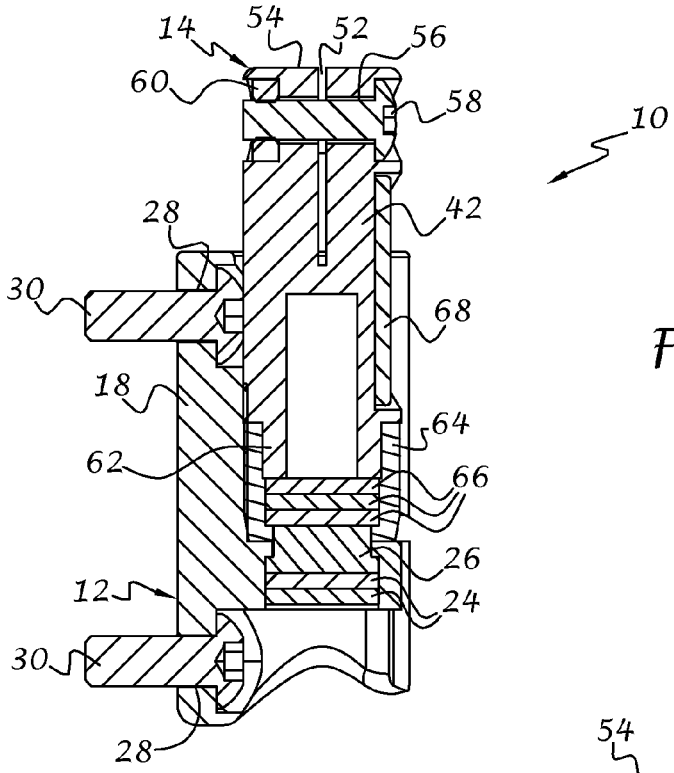
FIG. 6 is a sectional view of the quiver mount assembly taken along line 6-6 of FIG. 4.
Figure 7:
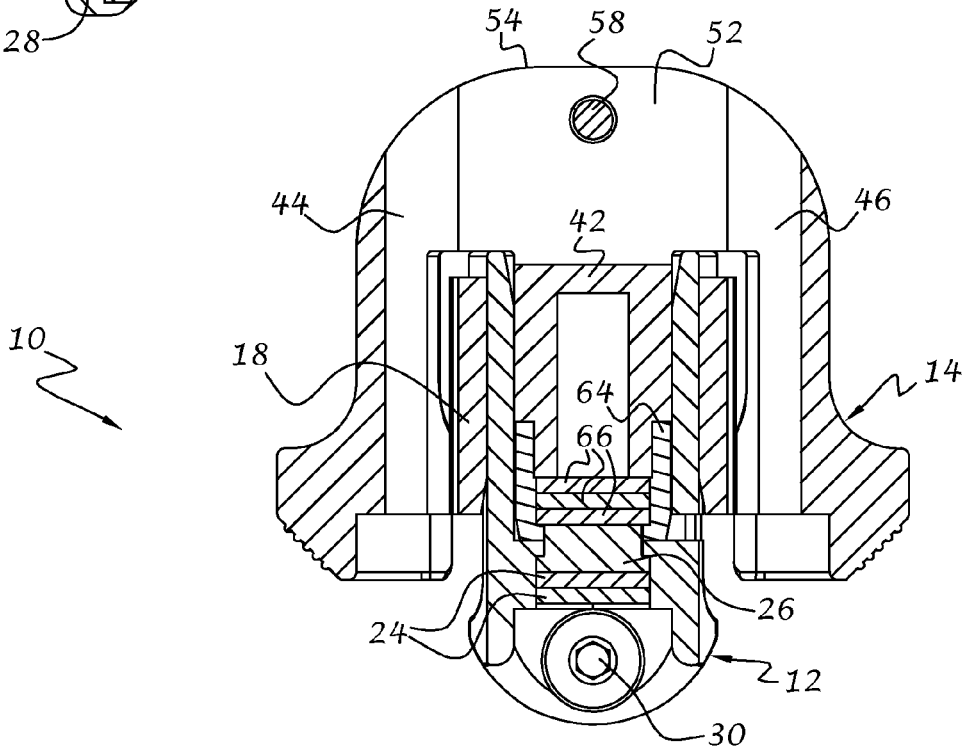
FIG. 7 is a sectional view of the quiver mount assembly taken along line 7-7 of FIG. 5.
Figure 8:
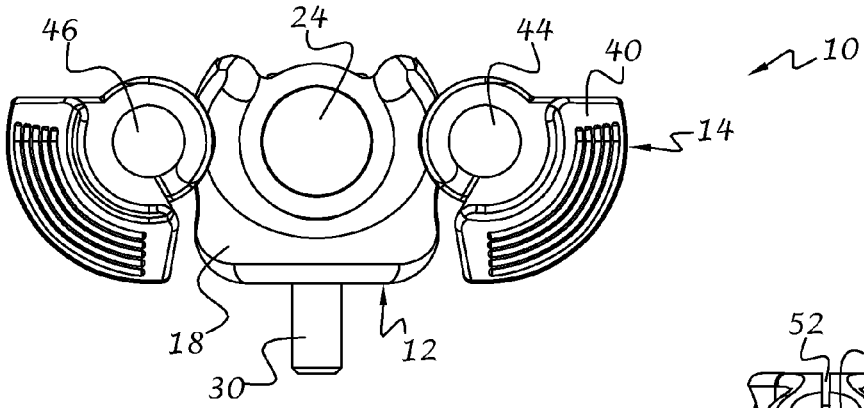
FIG. 8 is a bottom plan view of the quiver mount assembly.
Figure 9:
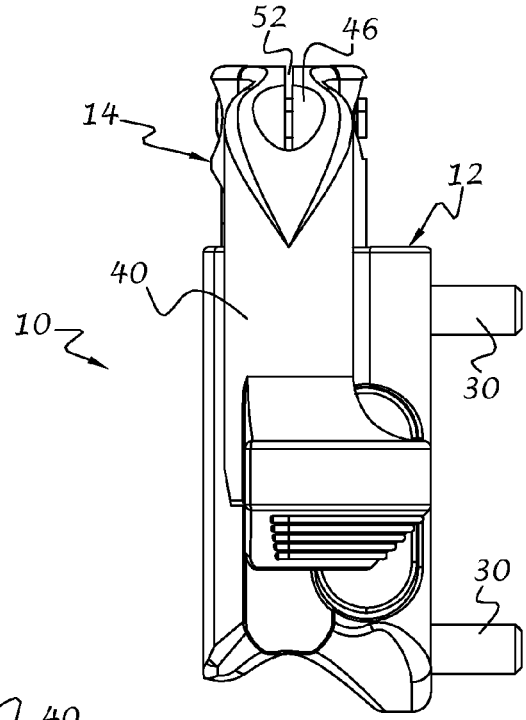
FIG. 9 is a side elevational view of the quiver mount assembly.
Figure 10:
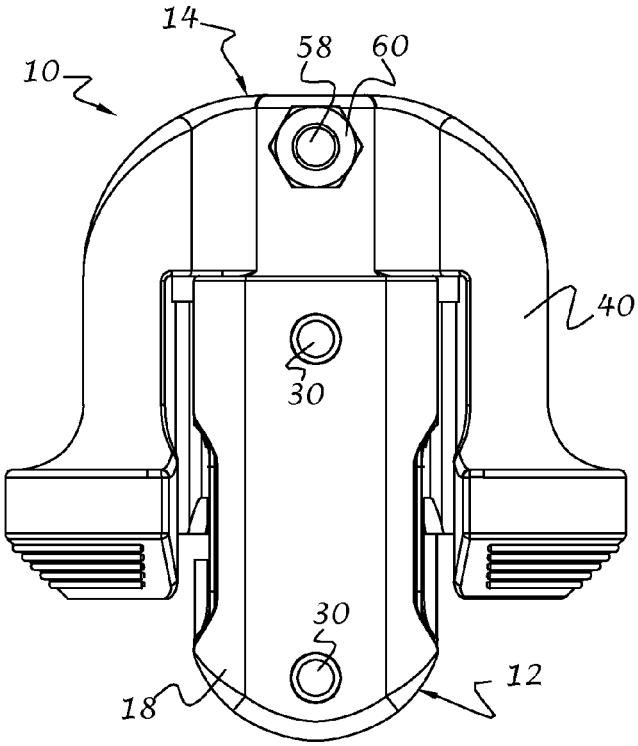
FIG. 10 is a rear elevational view of the quiver mount assembly.

In use, the bow mounting portion 12 is preferably secured to the bowsight mounting bracket which is in turn connected to the riser of a bow (not shown) as previously described. However, it will be understood that the bow mounting portion 12 can be connected to the riser either directly or through other intermediate members. The quiver 16 is connected to the quiver mounting portion 14 by loosening the screw 58 and sliding the rods 48 and 50 into the side bores 44 and 46, respectively. The screw 58 is then tightened to draw the slot 52 toward a closed or narrow position and thereby clamp the rods 48, 50 within their respective side bores 44, 46. The tubular member 42 of the quiver mounting portion 12 is then inserted into the cavity 20 of the bow mounting portion until the magnets 66 engage the plug 20 or at least until sufficient magnetic force is attained to thereby magnetically hold the quiver 16 to the bow. The combination of the magnets 24, plug 26, holder 64 and magnets 66, as best shown in FIG. 6, creates a complete magnetic circuit that provides sufficient magnetic forces to hold the mounting portions 12, 14 together when in use. When it is desired to remove the quiver, the user need simply exert enough force on the quiver mounting portion 12 and/or quiver 16 to overcome the force between the magnets of the quiver mounting portion and bow mounting portion. In this manner, the quiver 16 may be installed on and removed from the bow without the use of hand tools. Preferably, the tubular member 42 and cavity 20 are substantially similar in diameter to prevent movement between the mounting portions during use or transportation. Although the tubular member 42 and receptacle 20 are generally cylindrical in shape, it will be understood that the tubular member and receptacle can be of any complementary shape without departing from the spirit and scope of the present invention.

It will be understood that the term "preferably" as used throughout the specification refers to one or more exemplary embodiments of the invention and therefore is not to be interpreted in any limiting sense. It will be further understood that the term "connect" and its derivatives refers to two parts capable of being attached together either directly or indirectly through one or more intermediate members. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, the tubular member 42 of the second body section 40 and the receptacle or cavity 20 of the first body section 18 can be switched without departing from the spirit and scope of the present invention. It will be understood, therefore, that the present invention is not limited to the particular embodiments disclosed, but also covers modifications within the spirit and scope of the invention as defined by the appended claims.

What is claimed is:

1. A detachable quiver mount assembly comprising:

a bow mounting portion connectable to an archery bow, the bow mounting portion having a first body section with one of a receptacle and a protrusion extending along a first axis;

a quiver mounting portion having a second body section with the other of the receptacle and the protruding member extending along a second axis;

the protruding member being axially insertable into the receptacle to thereby align the mounting portions together and releasably to connect the quiver mounting portion to the bow mounting portion in an axial direction along the first and second axes; and at least one of the protruding member and the receptacle including at least one magnet for attracting and holding the mounting portions together in the axial direction.

2. A detachable quiver mount assembly according to claim 1, wherein the at least one magnet is at least located in the receptacle or on the protruding member and the other of the receptacle and protruding member is magnetically attractable to the at least one magnet to thereby releasably hold the mounting portions together in the axial direction.

3. A detachable quiver mount assembly according to claim 1, wherein:

the at least one magnet comprises a plurality of magnets; and the protruding member includes at least one of the magnets and the receptacle includes at least another of the magnets to thereby releasably hold the mounting portions together in the axial direction.

4. A detachable quiver mount assembly according to claim 3, wherein the at least one magnet of the protruding member and the at least one magnet of the receptacle are oriented in a similar polar direction.

5. A detachable quiver mount assembly according to claim 3, wherein the second body section includes a pair of closed side bores positioned on either side of the receptacle or protruding member, the side bores being connected by a slot that extends between the side bores to thereby adjust a size of the side bores; each side bore being adapted to receive and secure a quiver rod.

6. A detachable quiver mount assembly according to claim 1, wherein the second body section includes a pair of closed side bores positioned on either side of the receptacle or protruding member; each side bore being adapted to receive a rod of a quiver.

7. A detachable quiver mount assembly according to claim 6, and further comprising a slot extending between the side bores so that the side bores are adjustable to secure the quiver rods against movement within the side bores.

8. A detachable quiver mount assembly according to claim 1, and further comprising:

a first magnet portion located within the receptacle and including a first magnet and a plug constructed of magnetically permeable material; and a second magnet portion connected to the protruding member and including a second magnet and a holder constructed of magnetically permeable material.

9. A detachable quiver mount assembly comprising:

a bow mounting portion connectable to an archery bow, the bow mounting portion having a first body section with one of an axially extending receptacle and an axially extending protruding member; and a quiver mounting portion releasably connectable to the bow mounting portion, the quiver mounting portion having a second body section with the other of the axially extending receptacle and axially extending protruding member;

the protruding member being axially insertable into the receptacle to thereby connect the mounting portions together;

releasable holding means associated with at least one of the protruding member and the receptacle to detachably hold the mounting portions together, the releasable holding means comprising a first magnet portion located within the receptacle and a second magnet portion connected to the protruding member, the first and second magnet portions being mutually attracted when the protruding member is axially positioned into the receptacle for releasably securing the bow mounting portion and quiver mounting portion together.

10. A detachable quiver mount assembly according to claim 9, wherein the second body section includes a pair of closed side bores positioned on either side of the receptacle or protruding member; each side bore being adapted to receive a quiver rod.

11. A detachable quiver mount assembly according to claim 10, and further comprising a slot extending between the side bores so that the side bores are adjustable to secure the quiver rods against movement within the side bores.

12. A detachable quiver mount assembly according to claim 9, wherein the first body section includes the receptacle and the second body section includes the protruding member.

13. A detachable quiver mount assembly according to claim 9, wherein each magnet portion includes at least one magnet.

14. A detachable quiver mount assembly according to claim 9, wherein each magnet portion includes a plurality of stacked magnets for increasing a magnetic holding force between the bow mounting portion and the quiver mounting portion.

15. A detachable quiver mount assembly according to claim 9, wherein the first magnet portion includes a first magnet and a plug constructed of magnetically permeable material, and the second magnet portion includes a second magnet and a holder constructed of magnetically permeable material.

16. A detachable quiver mount assembly comprising:

a bow mounting portion connectable to an archery bow, the bow mounting portion having a first body section with a receptacle; and a quiver mounting portion releasably connectable to the bow mounting portion, the quiver mounting portion having a second body section with a protruding member;

the protruding member being insertable into the receptacle to thereby connect the mounting portions together; and releasable holding means associated with at least one of the protruding member and the receptacle to detachably hold the mounting portions together, the releasable holding means comprising a first magnet portion with a first plurality of stacked magnets located within the receptacle and a second magnet portion with a second plurality of stacked magnets connected to the protruding member, the first and second magnet portions being mutually attracted when the protruding member is positioned in the receptacle for releasably securing the bow mounting portion and quiver mounting portion together;

wherein the first magnet portion further includes a plug constructed of magnetically permeable material and the second magnet portion includes a holder constructed of magnetically permeable material, with the plug and holder being juxtaposed when the protruding member is located within the receptacle.

17. A detachable quiver mount assembly according to claim 16, wherein the plug is in contact with one of the magnets of the first magnet portion when the protruding member is located within the receptacle.

18. A detachable quiver mount assembly comprising:

a bow mounting portion connectable to an archery bow, the bow mounting portion having a first body section with a receptacle;

a quiver mounting portion releasably connectable to the bow mounting portion, the quiver mounting portion having a second body section with a protruding member, the protruding member being insertable into the receptacle to thereby connect the mounting portions together;

a first magnet portion located within the receptacle and including a first plurality of stacked magnets and a plug constructed of magnetically permeable material; and a second magnet portion connected to the protruding member and including a second plurality of stacked magnets and a holder constructed of magnetically permeable material;

the first and second magnet portions being mutually attracted when the protruding member is positioned in the receptacle for releasably securing the bow mounting portion and quiver mounting portion together.

19. A detachable quiver mount assembly according to claim 18, wherein the second body section includes a pair of side bores positioned on either side of the protruding member, each side bore being adapted to receive a quiver rod.

20. A detachable quiver mount assembly according to claim 19, wherein the side bores are adjustable to secure the quiver rods against movement within the side bores.

* * * * *